US008109084B2

(12) United States Patent
Morita et al.

(10) Patent No.: US 8,109,084 B2
(45) Date of Patent: Feb. 7, 2012

(54) EXHAUST DEVICE FOR MOTORCYCLE

(75) Inventors: Kenji Morita, Saitama (JP); Yuichi Tanaka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 870 days.

(21) Appl. No.: 12/055,871

(22) Filed: Mar. 26, 2008

(65) Prior Publication Data

US 2008/0236151 A1 Oct. 2, 2008

(30) Foreign Application Priority Data

Mar. 30, 2007 (JP) ..... 2007-095486

(51) Int. Cl.
*F01N 1/00* (2006.01)

(52) U.S. Cl. ..... 60/324; 60/292; 60/312; 60/314; 60/322; 60/323; 181/249; 181/253; 181/254; 181/255

(58) Field of Classification Search ..... 60/292, 60/312, 313, 314, 322, 323, 324; 181/249, 181/252, 253, 254, 255, 269
See application file for complete search history.

(56) References Cited

U.S. PATENT DOCUMENTS

| | | | | |
|---|---|---|---|---|
| 4,939,898 | A * | 7/1990 | Ichimura et al. | 60/274 |
| 5,134,850 | A * | 8/1992 | Saito et al. | 60/313 |
| 5,189,266 | A * | 2/1993 | Sasaki et al. | 181/227 |
| 6,454,047 | B1 * | 9/2002 | Galaitsis | 181/254 |
| 6,633,646 | B1 * | 10/2003 | Hwang | 381/71.5 |
| 6,938,729 | B2 * | 9/2005 | Worner et al. | 181/254 |
| 7,171,804 | B2 * | 2/2007 | Terashima | 60/323 |
| 7,458,210 | B2 * | 12/2008 | Kikuchi et al. | 60/323 |

FOREIGN PATENT DOCUMENTS

| | | |
|---|---|---|
| EP | 0 270 121 A2 | 6/1988 |
| EP | 1 464 824 A1 | 10/2004 |
| EP | 1 568 864 A1 | 8/2005 |
| JP | 63-255515 A | 10/1988 |

* cited by examiner

*Primary Examiner* — Binh Q Tran
(74) *Attorney, Agent, or Firm* — Birch, Stewart, Kolasch & Birch, LLP

(57) ABSTRACT

An exhaust throttle valve protected from disturbance due to stones scattered during operation of a vehicle. Front side exhaust pipes and rear side exhaust pipes are connected to a catalyst chamber disposed below a crankcase. The catalyst chamber and an exhaust chamber disposed to the rear thereof are connected to each other via a rear exhaust pipe. The diameter of the rear exhaust pipe is smaller than the lateral width of each of the catalyst chamber and the exhaust chamber, so that a recessed space is externally formed so as to recede inside of the vehicle. An exhaust throttle valve is received in the space. The exhaust throttle valve is partially exposed to the outside of the rear exhaust pipe and a throttle valve is received in the rear exhaust pipe to throttle-control the passage-sectional area of the rear exhaust pipe according to the rotation of the engine.

20 Claims, 8 Drawing Sheets

EXHAUST DEVICE FOR MOTORCYCLE

CROSS-REFERENCE TO RELATED APPLICATIONS

The present application claims priority under 35 USC 119 to Japanese Patent Application No. 2007-095486 filed on Mar. 30, 2007 the entire contents of which are hereby incorporated by reference.

BACKGROUND OF THE INVENTION

1. Field of the Invention

The present invention relates to an exhaust device for a motorcycle. More specifically, to an exhaust throttle valve arrangement structure advantageous to disturbance due to scattered stones or the like.

2. Description of Background Art

An exhaust throttle valve is known that is provided in the exhaust system of an engine to adjust an amount of exhaust flow according to operating conditions, thereby intending to reduce exhaust noise and to provide high power.

Examples of the provision of such an exhaust throttle valve include one in which the exhaust throttle valve is provided at a collecting portion disposed forward of an engine is disclosed in Japanese Utility Model Publication No. Hei 4-20983. In addition, another example of an exhaust throttle valve is provided at a collective exhaust pipe located near the front end of a muffler See, for example, Japanese Patent Laid-open No. Hei 4-292534.

Since the exhaust throttle valve is provided in the exhaust system, it is sometimes disposed close to a front wheel or a rear wheel or on the vehicle body lower portion close to the ground surface. If the exhaust throttle valve is located at any one of such positions, it tends to undergo a disturbance due to the scattered of stones or the like.

For Japanese Utility Model Publication No. Hei 4-20983, a rotational arm or drive wire of the exhaust throttle valve is located on the lateral surface of a collective portion forward of the lower portion of an engine, that is, located rearward of and close to the front wheel. Thus, stones or the like scattered by the front wheel tends to cause a disturbance.

For Japanese Patent Laid-open No. Hei 4-292534, the drive portion or the like of the exhaust throttle valve is exposed to the vicinity of the front end of the muffler located laterally of the rear wheel. Thus, it is desirable to provide a structure that protects it from being disturbed due to stones scattered by the front wheel or the rear wheel.

In addition, it is desired that the structure for protecting such a component from disturbances due to scattered stones or the like be realized as simply as possible. Accordingly, an object of the invention is to meet such a desire.

SUMMARY AND OBJECTS OF THE INVENTION

To solve the above problem, according to an embodiment of the present invention an exhaust device for a motorcycle is provided that includes a plurality of exhaust pipes connected to associated exhaust ports of a multicylinder engine. A collecting portion is provided for collecting the exhaust pipes at a position close to the lower portion of the engine. A rear exhaust pipe is connected to the downstream side of the collecting portion with an exhaust chamber connected to the downstream side of the rear exhaust pipe. An exhaust outlet portion is provided on the downstream side of the exhaust chamber with a muffler connected to the downstream side of the exhaust outlet portion. An exhaust throttle valve is disposed inside a passage of the rear exhaust pipe to change an amount of exhaust flow.

According to an embodiment of the present invention, a lateral width of the collecting portion is greater than a lateral width of the rear exhaust pipe including the exhaust throttle valve, as viewed from above.

According to an embodiment of the present invention, the lateral width of the exhaust chamber is greater than that of the rear exhaust pipe including the exhaust throttle valve, as viewed from above.

According to an embodiment of the present invention, the muffler is formed such that a vehicle-widthwise outside thereof is slanted to externally open toward the rear.

According to an embodiment of the present invention, a back-and-forth length of a portion, of the exhaust throttle valve, disposed outside of the rear exhaust pipe is approximately equal to a back-and-forth length of the rear exhaust pipe.

According to an embodiment of the present invention, the exhaust throttle valve is disposed to recede from an external lateral portion of the collecting portion toward the inside of a vehicle body.

According to an embodiment of the present invention, a side stand during storage or an attachment portion overlaps the outside of the exhaust throttle valve as viewed from the side.

According to an embodiment of the present invention, the exhaust throttle valve is attached to the rear exhaust pipe at a position between the collecting portion disposed near the lower portion of the engine and the exhaust chamber disposed downstream of the collecting portion and connected thereto via the rear exhaust pipe. Therefore, the exhaust throttle valve is surrounded by the collecting portion and the exhaust chamber so that it can be protected from disturbance due to stones or the like scattered by the front wheel or the like.

According to an embodiment of the present invention, the lateral width of the collecting portion disposed forward of the exhaust throttle valve is made greater than the lateral width of the rear exhaust pipe including the exhaust throttle valve, whereby the external side of the collecting portion is made to protrude externally from the rear exhaust pipe. Therefore, the collecting portion can protect the exhaust throttle valve against disturbance due to scattered stones or the like. In particular, the exhaust throttle valve can be protected from disturbance due to stones scattered from the front of the vehicle during operation of the vehicle.

According to an embodiment of the present invention, the lateral width of the exhaust chamber disposed rearward of the exhaust throttle valve is made greater than that of the rear exhaust pipe including the exhaust throttle valve. Therefore, the exhaust throttle valve can be prevented from being hit by disturbance due to scattered stones bounced from the rear portion of the vehicle.

According to an embodiment of the present invention, the muffler is formed such that the vehicle-widthwise outside thereof is slanted to externally open toward the rear. If a disturbance due to stones scattered from the front of the vehicle hits the muffler, they can bounce obliquely externally and rearwardly from the externally opening slant surface. Thus, the exhaust throttle valve can be prevented from being hit by disturbances due to stones scattered from the front of the vehicle and bounced from the muffler.

According to an embodiment of the present invention, the collecting portion and exhaust chamber which are components larger than the exhaust throttle valve are disposed forward of and rearward of, respectively, the exhaust throttle valve with respect to the vehicle. In addition, the back-and-forth length of the rear exhaust pipe which corresponds to the interval between the collecting portion and the exhaust chamber is made approximately equal to the back-and-forth length of the exhaust throttle valve. Therefore, the back-and-forth interval of the exhaust throttle valve can be reduced by the collecting portion and by the exhaust chamber. This can prevent the exhaust throttle valve from being hit by disturbances due to scattered stones or the like.

According to an embodiment of the present invention, the exhaust throttle valve is disposed to recede from the external lateral portion of the collecting portion toward the inside of the vehicle body. Therefore, the exhaust throttle valve can easily be protected from disturbances due to scattered stones or the like.

According to an embodiment of the present invention, the side stand during storage or the attachment portion is made to overlap the outside of the exhaust throttle valve. Therefore, the side stand during storage or the attachment portion covers the exhaust throttle valve from the externally lateral side thereof to protect it from disturbances due to scattered stones or the like.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
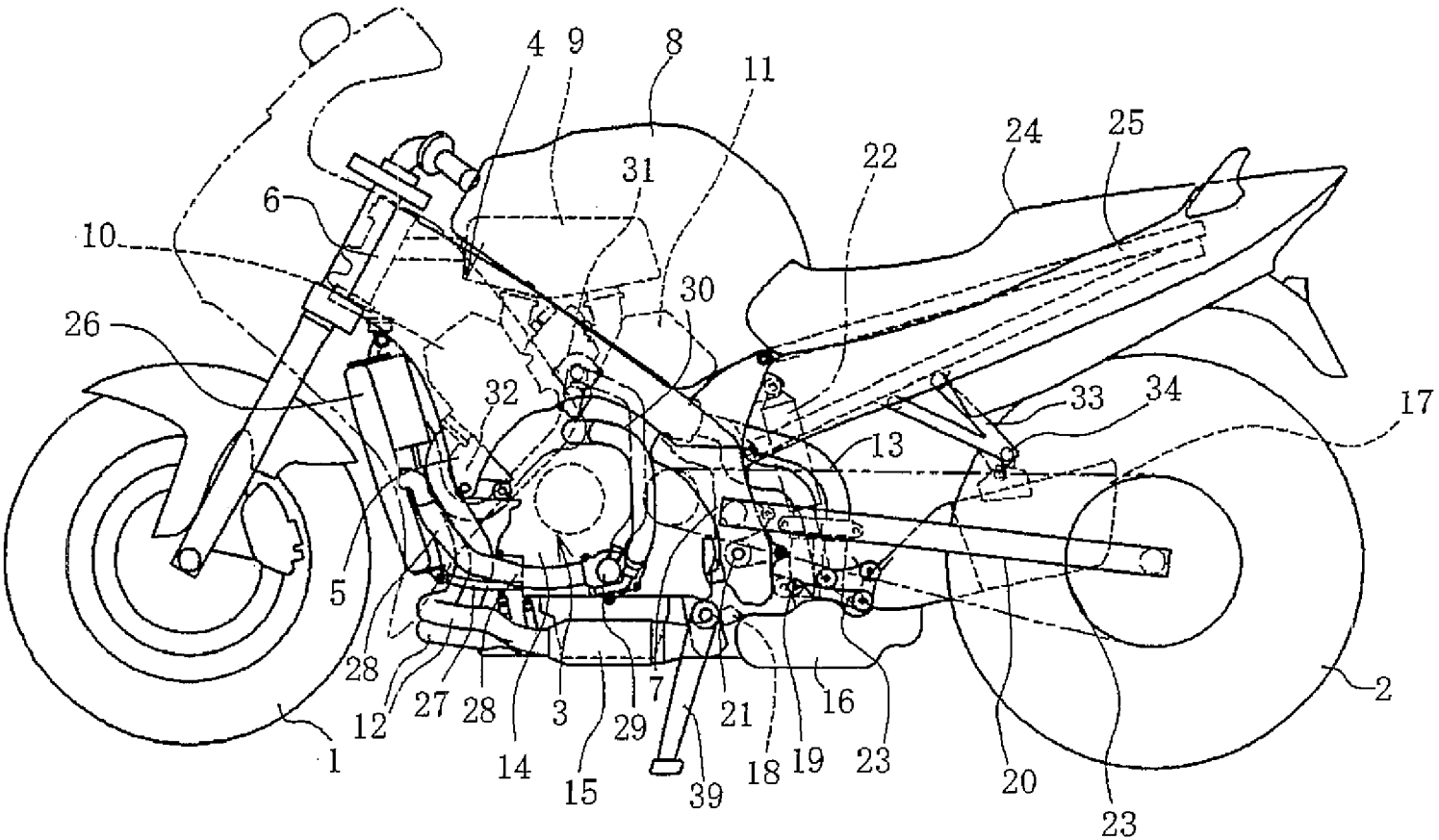
FIG. 1 is a lateral view of a motorcycle according to an embodiment.

An embodiment will hereinafter be described with reference to the drawings. FIG. 1 is a lateral view of a motorcycle according to the embodiment. The motorcycle is such that a V-type water-cooled 4-cylinder engine 3 is disposed between a front wheel 1 and a rear wheel 2 and supported by a body frame 4.

A hanger 5 is attached to the intermediate portion of the body frame 4 so as to support the front portion of the engine 3. A head pipe 6 is attached to the front end of the body frame 4 and a pivot plate 7 is supported by the rear portion of the body frame 4. A fuel tank 8 is supported on the intermediate portion of the body frame 4 and an air intake box 9 is received inside the front portion of the fuel tank 8.

The air intake box 9 sucks air from the front and supplies the air to front cylinders 10 and rear cylinders 11 located below the air intake box 9. The air intake box 9 is disposed above the valley portion between the front cylinders 10 and the rear cylinders 11.

Front side exhaust pipes 12 extend forward from the respective front cylinders 10. Rear side exhaust pipes 13 extend rearwardly from the respective rear cylinders 11. The front side exhaust pipes 12 extend downwardly along the front surface of a crankcase 14 of the engine 3 and connect, from the front, with a catalyst chamber 15 located below the crankcase 14, via a collecting pipe. Also the rear side exhaust pipes 13 connect, from the front, with the catalyst chamber 15 via another collecting pipe as described later.

The catalyst chamber 15 connects with an exhaust chamber 16 and an expansion chamber disposed rearward thereof. The exhaust chamber 16 is disposed in a space defined between the lower portion of the crankcase 14 and the rear wheel 2 and connects with a muffler 17 extending on the right side of the rear wheel 2 with respect to the vehicle body. The exhaust chamber 16 is supported by the lower end of the pivot plate 7 at two, front and rear, attachment portions 18, 19.

The muffler 17 is disposed to cross a rear swing arm 20 as viewed from the side. The rear swing arm 20 has a front end portion which is supported by the lower portion of the muffler 17 with the pivot shaft 21 so as to be swingable up and down and is suspended by a rear shock absorber 22 provided between the upper end of the pivot plate 7 and the rear swing arm 20.

A suspension link 23 is provided between the lower end of the pivot plate 7 and the intermediate portion of the attachment portion 18. The exhaust chamber 16 is disposed below the suspension link 23 so as to avoid the suspension link 23. The front end of the muffler 17 is located at a position approximately equal to that of the suspension link 23 higher, by one step, than the exhaust chamber 16.

The rear wheel 2 is of a shaft drive type and is driven by the engine 3. A seat 24 is supported on a seat rail 25 so as to be located above the rear swing arm 20 and to the rear of the fuel tank 8. The seat rail 25 is supported by the pivot plate 7 at its front end.

A radiator 26 is disposed forward of the front cylinders 10 and to the rear of the front wheel 1 and has an upper portion suspended and supported by the front portion, of the body frame 4, close to the head pipe 6. The radiator 26 is supported with the head bent forward in which the upper portion is slanted forward. A gap is defined between the radiator 26, and the front cylinders 10 and the crankcase 14. The front side exhaust pipes 12 are vertically passed through the gap.

The lower end of the radiator 26 is supported by the crankcase 14 via a stay 27 extending forward from the front lower portion of the crankcase 14. A feed-water hose 28 extends to the rear from a lateral tank of the radiator 26 and connects with a feed-water pump 29 provided at the lateral portion of the crankcase 14.

Water is fed from the feed-water pump 29 via a joint hose 30 to a water jacket feed-water portion provided in the valley between the front cylinders 10 and the rear cylinders 11. The water is then fed from the water jacket feed-water portion to the respective water jackets of the front cylinders 10 and the rear cylinders 11. The water circulates the water jackets to cool the cylinders for heat exchange and the water thus heated is fed to a return hose 32 via a thermostat 31 located above the feed-water portion in the valley between the front cylinders 10 and the rear cylinders 11.

The return hose 32 extends downward to the lateral surface of the crankcase 14, then extending forward, and connects with the lateral tank of the radiator 26. In this way, the heated water is returned by the return hose 32 to the radiator 26.

Figure 2:
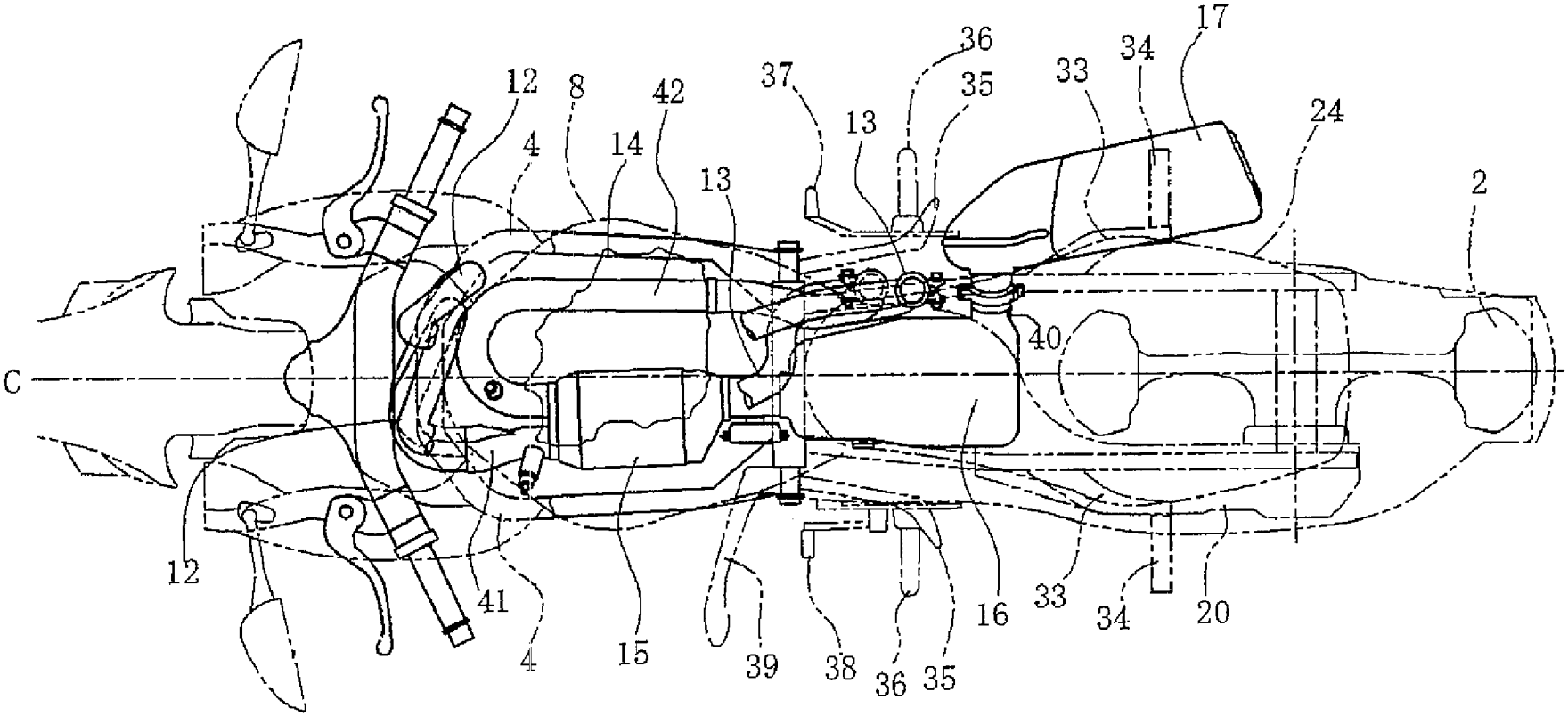
FIG. 2 is a plan view mainly illustrating an exhaust system.

FIG. 2 is a plan view mainly illustrating an exhaust system. The catalyst chamber 15 is disposed to be offset to the left with respect to the body center C and the exhaust chamber 16 is located approximately on the body center C. A laterally-facing outlet pipe 40 is provided at a right-hand rear end portion of the exhaust chamber 16 so as to project to the right outwardly and joined to the left-lateral surface of the front end of the muffler 17. The muffler 17 is disposed to extend in the back and forth direction and slanted so that its rear side opens outwardly toward the right side of the vehicle body.

The two front side exhaust pipes 12 are provided in total for the respective left and right cylinders. The front side exhaust pipes 12 extend downward and toward the right side of the vehicle body, bending at their lower portions and crossing the vehicle-widthwise direction from the right side of the vehicle body to the left side, collectively join to the collecting pipe 41 and connect with the catalyst chamber 15. Also the two rear side exhaust pipes 13 are provided in total for the respective left and right cylinders, extending downward, and collectively join to the single rear collecting pipe 42. The rear collecting pipe 42 extends downward of and to the right of the crankcase 14 not to interfere therewith, extends from the rear to the front, turning leftward of the vehicle body at a position close to the lower portions of the front side exhaust pipes 12, and connects, from the front, with the catalyst chamber 15 inward of the front collecting pipe 41. The crankcase 14 partially overlaps the catalyst chamber 15 and rear collecting pipe 42 as viewed from above.

A pillion step holder 33 is provided right and left of the vehicle body. The right pillion step holder 33 supports the muffler 17 at its lower end portion. A pillion step 34 is provided together with a step holder 35 supported by the seat rail 25. A step 36, a brake pedal 37, a change pedal 38 and a side stand 39 are provided. These components are supported by the lower portion of the pivot plate 7.

Figure 3:
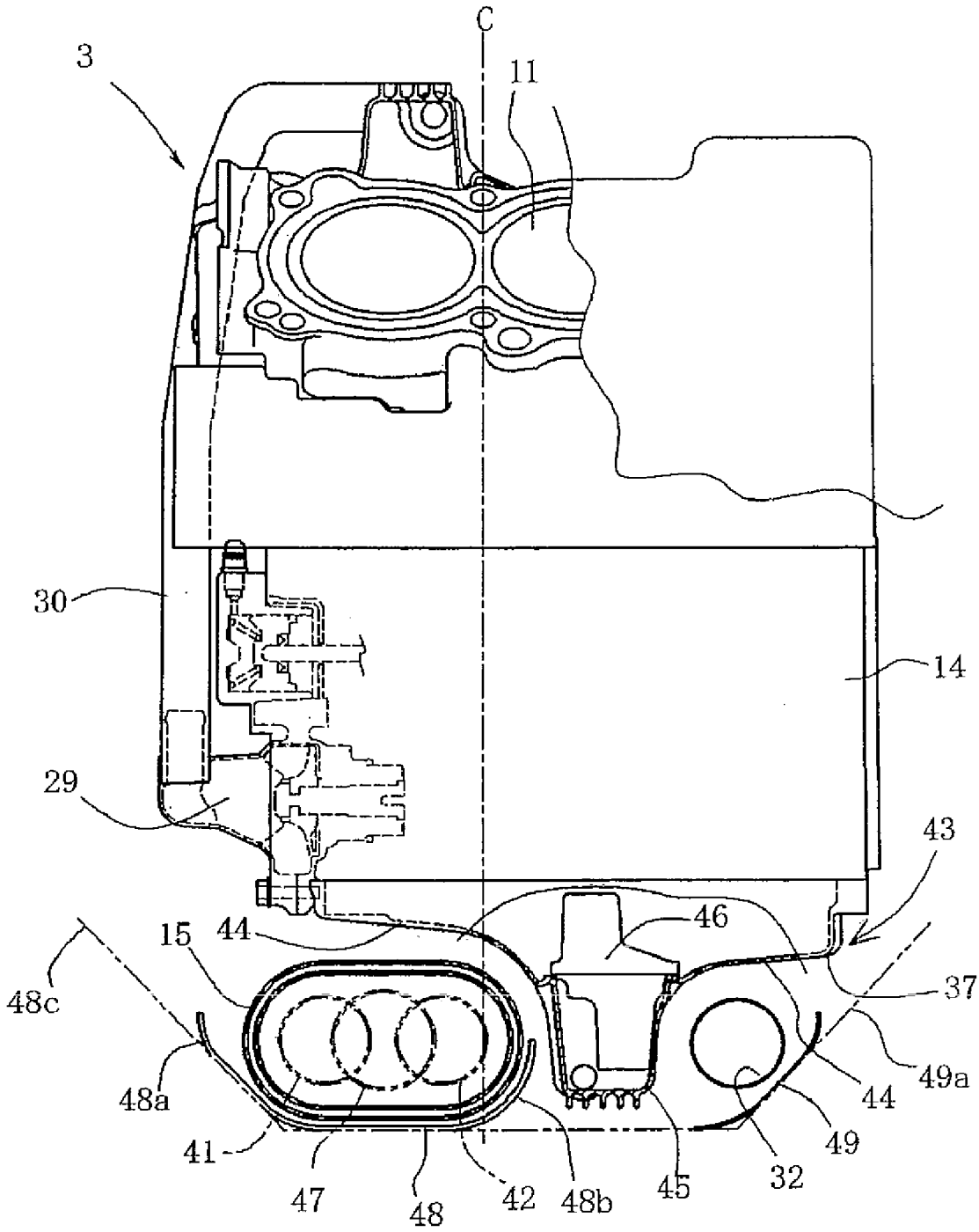
FIG. 3 illustrates an engine from rear.

FIG. 3 illustrates the engine 3 as viewed from the rear. An oil pan 43 is attached to the bottom portion of the crankcase 14. The oil pan 43 is formed to have a curved surface such that its bottom portion 44 is lower toward the vehicle-widthwise center. The central portion of the bottom portion 44 protrudes lengthwise downwardly to form a reservoir chamber 45. A portion, of the bottom portion 44, excluding the reservoir chamber 45 functions as an introduction portion for guiding oil into the reservoir chamber 45 and does not function so much to store oil thereon, so that it can be thinned. Thus, the oil pan 43 is formed thin as a whole and in an almost-T shape as viewed from the rear (or as viewed from the front).

Figure 5:
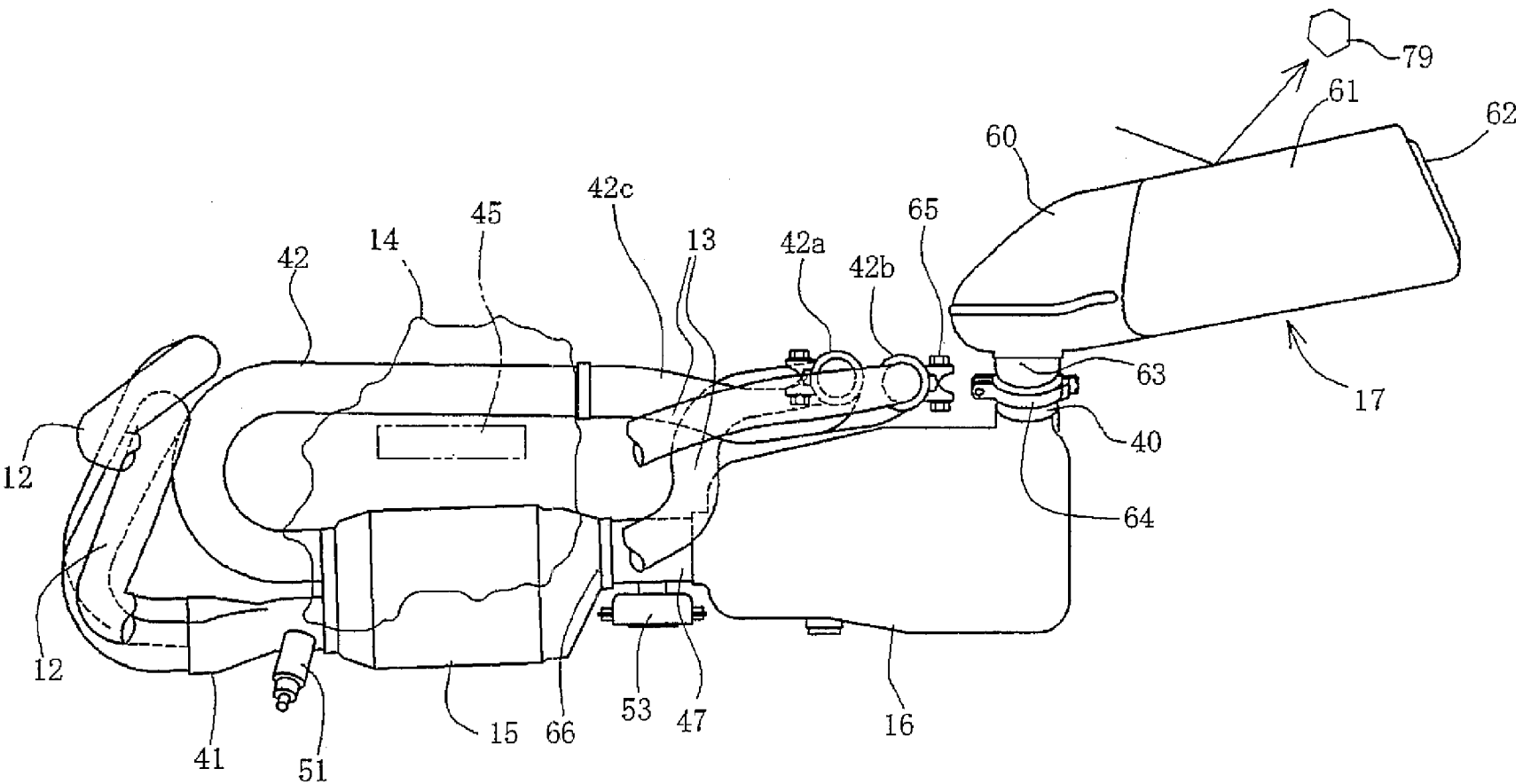
FIG. 5 is a plan view of the exhaust system.

The reservoir chamber 45 is formed like a recessed groove that is narrow, relatively deep and elongated in the back and forth direction (see FIG. 5). An arrangement space for the rear collecting pipe 42 and the catalyst chamber 15 is sufficiently widely and is ensured to be right and left of the reservoir chamber 45. The upper portion of the reservoir chamber 45 merges with the bottom portion 44 protruding right and left so that oil can efficiently be collected into the reservoir chamber 45. A strainer 46 is received in the oil pan 43 and its suction port is disposed close to the bottom portion of reservoir chamber 45. An oil pump not shown in the crankcase 14 sucks upwardly the oil collected in the deep reservoir chamber 45 and feeds it to the journal portions of the cylinders and other portions needing lubrication. Since the suction port of the strainer 46 is disposed near the bottom portion of the narrow, relatively deep reservoir chamber 45, a necessary amount of oil can be ensured around the suction port so that the oil can stably be sucked even when the vehicle body is tilted. The rear collecting pipe 42 and the catalyst chamber 15 are disposed on the right and left, respectively, of the reservoir chamber 45 so as to be close thereto lengthwise in the back and forth direction.

The reservoir chamber 45 is provided at a position slightly offset from the body center C to the right so that a relatively large space is formed below the bottom portion 44 on the left side of the reservoir chamber 45. The catalyst chamber 15 is disposed in the space. A front collecting pipe 41 and a rear collecting pipe 42 are joined to the front surface of the catalyst chamber 15 and a rear exhaust pipe 47 is joined to the rear surface of the catalyst chamber 15. The catalyst chamber 15 is a relatively-flat cylindrical body formed in a horizontally-long circle in cross-section and internally receives a known exhaust purification catalyst with a honeycomb structure or the like.

A guard plate 48 is disposed on the under side of the catalyst chamber 15. The guard plate 48 includes left and right bent lateral portions 48*a*, 48*b*, which extend to surround the catalyst chamber 15 from the left and from the right. The right lateral portion 48*b* is formed like a curved surface along the catalyst chamber 15 to enter into between the catalyst chamber 15 and the reservoir chamber 15. The guard plate 48 is disposed to slant along the left bank line 48*c*.

A space slightly smaller than the left-hand space is provided also on the right side of the reservoir chamber 45 and below the bottom portion 44. The single rear collecting pipe 42 is passed through this space in the back and forth direction. Also a guide plate 49 is provided to the right and obliquely downward of the rear collecting pipe 42. The guide plate 49 is also disposed to slant along a right-hand bank line 49*a*. The left and right bank lines 48*c*, 49*a* are lines each indicating the bank angle of the vehicle body.

Figure 4:
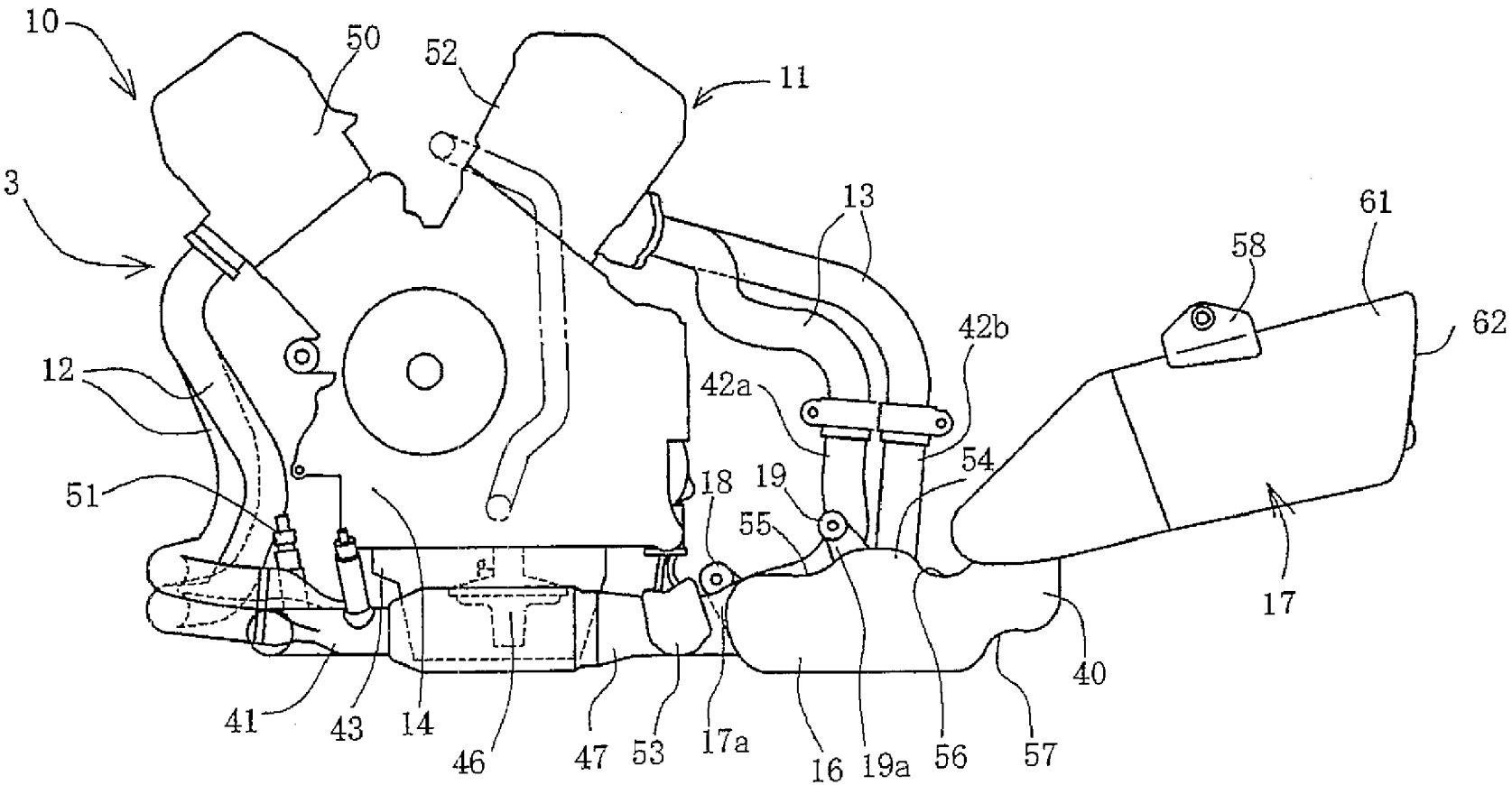
FIG. 4 is a lateral view of the exhaust system.

The exhaust system is hereinafter described in further detail. FIG. 4 is a lateral view of the exhaust system. Cylinder heads 50 of the front cylinders 10 are provided to the right and to the left. The two front side exhaust pipes 12 connected to the respective exhaust ports of the cylinder heads 50 extend downwardly in front of the crankcase 14, bending at their lower ends, and connect with the approximately Y-shaped front pipe 41. The rear side of the front collecting pipe 41 is formed as a single one, which connects with the catalyst chamber 15. An $O_2$ sensor 51 is provided right before the joint portion with the catalyst chamber 15 so as to project upwardly from the upper surface thereof.

In addition, another $O_2$ sensor 51 is provided, so as to project upwardly, at a position close to the joint portion between the catalyst chamber 15 and the rear collecting pipe 42 which cannot be seen in the figure because of being superposed by the front collecting pipe 41. The $O_2$ sensor 51 measures oxygen concentration in the exhaust gas before purification.

Cylinder heads 52 of the rear cylinders 11 are provided right and left. The two rear side exhaust pipes 13 connected to the respective exhaust ports of the cylinder heads 52 extend obliquely downwardly and rearwardly, bending at a position above the exhaust chamber 16, extending approximately vertically downwardly, and are connect with branch portions 42*a*, 42*b* of the rear pipe 42 which is also approximately Y-shaped.

A drive portion of an exhaust throttle valve 53 is provided, so as to be exposed, at the lateral surface of the rear exhaust pipe 47 which connects the rear portion of the catalyst chamber 15 with the front portion of the exhaust chamber 16. The exhaust throttle valve 53 is designed to control an amount of exhaust gas by changing the passage-sectional area of the rear exhaust pipe 47 according to the traveling conditions.

The respective bottom surfaces of the catalyst chamber 15 and the exhaust chamber 16 are located on respective horizontal lines H having approximately the same height to ensure a sufficient minimum ground clearance. However, the vertical width (thickness) of the exhaust chamber 16 is greater than that of the catalyst chamber 15. The exhaust chamber 16 ensures the necessary vertical width by extending the upper surface upward. This is enabled by disposing the exhaust chamber 16 in the space put between the lower portion of the engine 3 and the rear wheel from front and from rear and by using the space formed below the rear swing arm 20 (FIG. 1) located above the exhaust chamber 16.

The exhaust chamber 16 is formed with a raised portion 54 at the intermediate portion of the upper surface thereof and recessed portions 55, 56 are respectively provided forward of and rearward of the raised portion 54. The recessed portion 55 is adapted to avoid the lower end portion of the pivot plate 7 and similarly the recessed portion 56 is adapted to avoid the suspension link 23.

The attachment portion 18 is provided at the end of a stay 18*a* and projects upwardly from the front end of the exhaust chamber 16. Similarly, the attachment portion 19 is provided at the end of a stay 19*a* and projects upwardly from the raised portion 54 of the exhaust chamber 16. Thus, the exhaust chamber 16 is rubber-mounted to the pivot plate 7. The outlet pipe 40 extends rearwardly from the rear end of the exhaust chamber 16 while being reduced in diameter. To form the outlet pipe 40, a recessed portion 57 is formed by reducing the diameter of the rear end portion of the exhaust chamber 16.

The muffler 17 includes a front portion 60 formed in an approximate triangle and a main body portion 61, which are lined and welded integrally with each other. The outlet pipe 40 is joined to the lateral surface of the front portion 60 close to an acute front end portion 60*a* thereof. An upper surface 60*b* of the front portion 60 is formed as a taper surface which extends forwardly and obliquely downwardly. The front end portion 60*a* of the front portion 60 partially overlaps the rear end portion of the exhaust chamber 16 at a portion of the outlet pipe 40.

The main body portion 61 is formed like a tube having an approximately uniform diameter. A rear end portion of the main body portion 61 is closed by an end cap 62 whose upper portion projects rearward from the other portion. A stay 58 is attached to the pillion step holder 33 (FIG. 1).

FIG. 5 is a plan view of the exhaust system. The front side exhaust pipes 12 have respective lower portions which bend vehicle-widthwise at a position forward of the rear collecting pipe 42 and overlap one on another. The rear side exhaust pipes 13 overlap one on another along the right-hand surface of the exhaust chamber 16, extending rearwardly to the vicinity of the outlet pipe 40, then bending downwardly, and are connect with the branch portions 42*a*, 42*b* of the rear collecting pipe 42.

The outlet pipe 40 projects to the right from the internal surface of the rear end portion of the exhaust chamber 16 and is connected to a front pipe 63 with a band 64. The front pipe 63 projects to the left from the internal surface of the front end portion of the front portion 60. In addition, the front pipe 63 is an inlet pipe of the muffler 17.

The joint portion between the outlet pipe 40 and the front pipe 63 is located slightly rearwardly from the front end portion 60*a* of the front portion 60 of the muffler 17 to form a space there. A band 65 used to secure a joint portion between the rear side exhaust pipe 13 and the rear collecting pipe 42 partially faces this space. An external surface 60*c* of the front portion 60 of the muffler 17 is formed as a taper surface which slants so that its front side faces the central side of the vehicle body.

An external surface 15*d* of a rear wall 15*c* of the catalyst chamber 15 is formed as a taper surface whose rear side enters inside the vehicle body and is reduced in diameter to have approximately the same diameter as that of the rear exhaust pipe 47. A recessed space surrounded by the rear wall 15*c* and the front wall 16*a* of the exhaust chamber 16 is formed externally of the rear exhaust pipe 47. The exhaust throttle valve 53 is received in this recessed space to be protected from scattered stones or the like.

Figure 6:
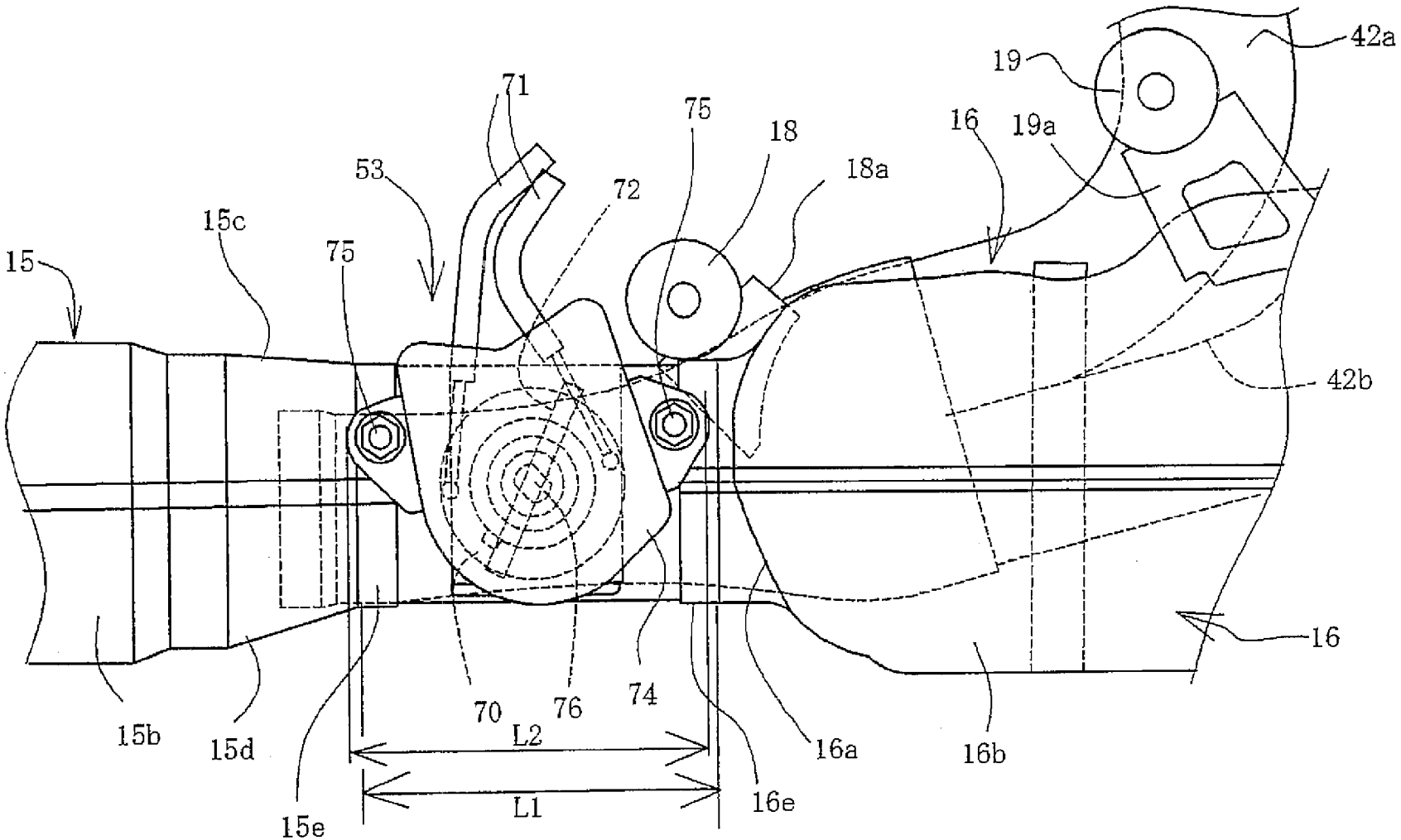
FIG. 6 is an enlarged lateral view illustrating a portion mainly including a muffler.
Figure 7:
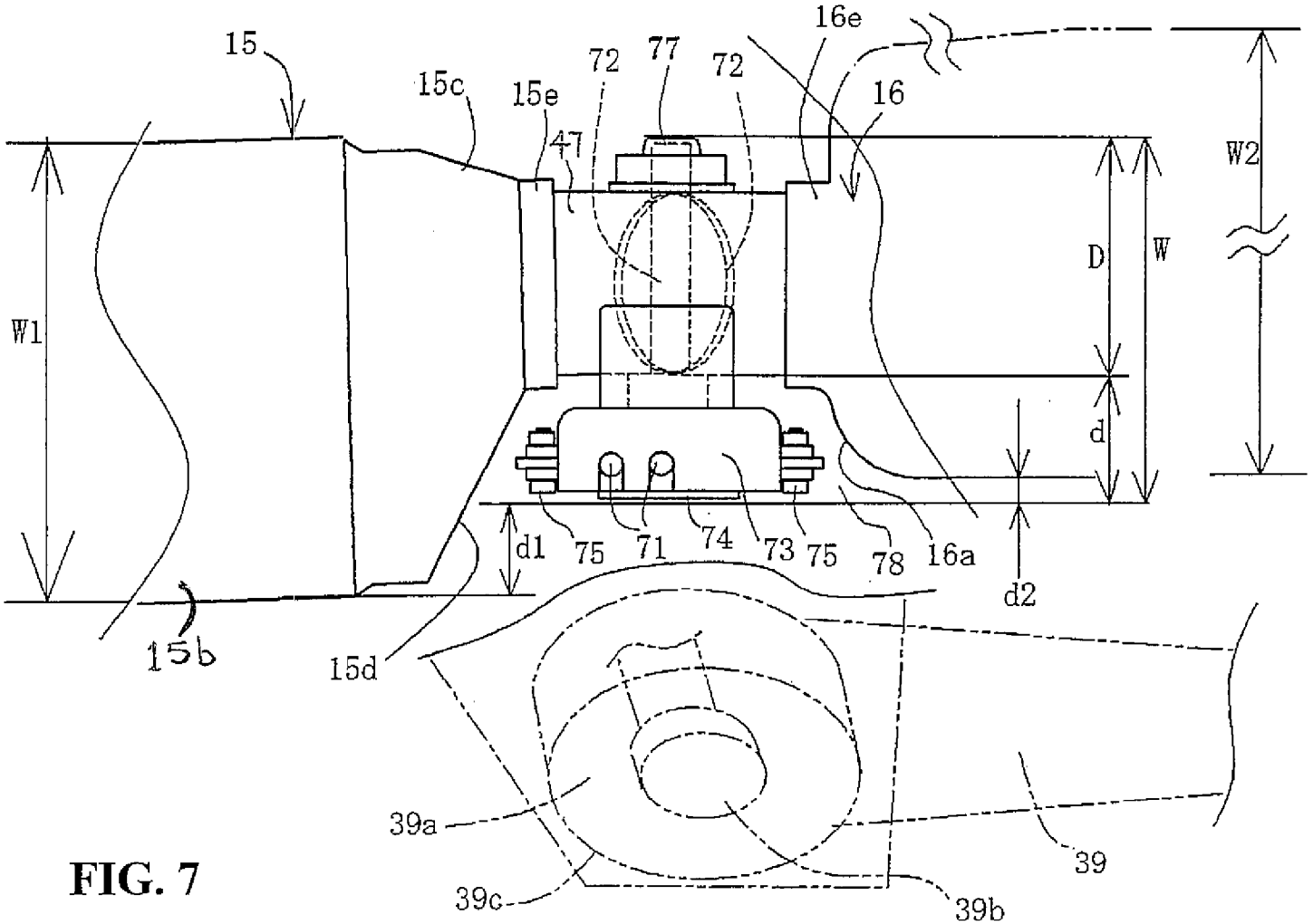
FIG. 7 is an enlarged plan view of FIG. 6.

A description is next made of the arrangement of the exhaust throttle valve 53. FIG. 6 is an enlarged lateral view of the exhaust throttle valve 53 and FIG. 7 is an enlarged plan view of FIG. 6. Referring to FIG. 6, the exhaust throttle valve 53 is attached to the external lateral surface of the rear exhaust pipe 47 so as to be put between the catalyst chamber 15 and the exhaust chamber 16 from the front and from the back. A pulley 70 is provided in the exhaust throttle valve 53 and is turnably driven by cables 71 to turn a throttle valve 72 provided inside the rear exhaust pipe 47, thereby adjusting an amount of exhaust gas. The cables 71 extend upward from the upper portion of the exhaust throttle valve 53 and are turned by an actuator not shown on the basis of the rotation number of the engine.

The throttle valve 72 is provided integrally with the pulley 70 for rotation and the passage-sectional area of the rear exhaust pipe 47 is variably controlled to adjust an amount of exhaust flow. The throttling by the throttle valve 72 is controlled by a controller not shown on the basis of the rotation number of the engine. During low-speed rotation, the throttle valve 72 is closed to reduce exhaust noise. During high-speed rotation, the throttle valve 72 is opened to enable high power. However, known control methods, types, structures and the like can be applicable.

A drive portion of the exhaust throttle valve 53 is a portion thereof exposed to the external lateral surface of the rear exhaust pipe 47. A back-and-forth length L1 of this drive portion is approximately equal to a back-and-forth length L2 of the rear exhaust pipe 47. In addition, the back-and-forth length L2 of the rear exhaust pipe 47 includes the respective lengths of a connection flange 15*e* provided on a rear wall 15*c* of the catalyst chamber 15 and a connection flange 16*e* provided on a front wall 16*a* of the exhaust chamber 16. In this way, the catalyst chamber 15 and exhaust chamber 16 which are large-size components can be compactly disposed with respect to the exhaust throttle valve 53 from front and from back.

Referring to FIG. 7, the exhaust throttle valve 53 is provided with a case 73 which projects externally to the side of the rear exhaust pipe 47 and is covered, from the external side, with a lid 74 secured thereto with bolts 75. A rotary shaft 76 is turned integrally with the pulley 70 and passes through the rear exhaust pipe 47, projects from the right lateral surface thereof and is secured thereto with an attachment 77. In this way, the exhaust throttle valve 53 is integrally attached to the rear exhaust pipe 47. The throttle valve 72 is integrally attached to the rotary shaft 76 in the rear exhaust pipe 47. The throttle valve 72 may be of a known type such as a butterfly valve or the like.

If a pipe diameter of the rear exhaust pipe 47 and the attachment 77 is D and a vehicle-widthwise width including the exhaust throttle valve is W, each of the respective vehicle-widthwise widths W1 and W2 of the catalyst chamber 15 and exhaust chamber 16 is greater than the pipe diameter of the rear exhaust pipe 47.

A drive portion which is a portion of the exhaust throttle valve 53 and includes the case 73 and the lid 74 is exposed to the outside of the rear exhaust pipe 47 and externally protrudes by a dimension d. The external surface 15*b* of the catalyst chamber 15 protrudes externally laterally from the exposure portion of the external throttle valve 53 by D1 and the external surface 16*b* of the exhaust chamber 16 recedes from the exposure portion of the external throttle valve 53 by d2. However, d2 is very small.

The rear wall 15*c* of the catalyst chamber 15 is reduced in diameter toward the inside of the vehicle body to form a slant surface and in particular the external surface 15*d* is largely slanted. Also the front wall 16*a* of the catalyst chamber 15 projects externally laterally and is nearly equally to the case 73. Thus, the external surface 15*d*, the rear exhaust pipe 47 and the front wall 16*a* define a recessed space 78 receding into the inward of the vehicle body. The exposure portion such as the case 73 and the like is received inside the recessed space 78.

In this way, the exposure portion such as the case 73 and the like is guarded by the external surface 15*d* from the front and by the front wall 16*a* from the rear so as to be protected against disturbance due to scattered stones or the like.

In addition, as indicated with imaginary lines in FIG. 7, also the exposure portion can be protected against disturbance due to scattered stones or the like by using the side stand 39. In FIG. 7, a vehicle body attachment portion of the side stand 39 is disposed externally of the exhaust throttle valve 53 by way of example. A boss portion 39*a*, which is the vehicle body attachment portion provided at one end of the side stand, is turnably attached to a support plate 39*c* with a bolt 39*b*. While being stored, the side stand 39 is turned to be approximately horizontal so that its rear end side is moved to the rear. The support plate 39*c* is attached to the lower portion of the pivot plate 7 (FIG. 1). In this way, the exhaust throttle valve 53 can be protected against disturbance due to scattered stones by the vehicle body attachment portion of the side stand 39.

The vehicle body attachment portion of the side stand 39 may be removed forward and the side stand may be approximately parallel to the rear exhaust pipe 47 during storage so as to cover the exhaust throttle valve 53 from the outside. In this case, the side stand 39 stored during operation can effectively be used to protect the exhaust throttle valve 53 against disturbance due to scattered stones or the like.

Figure 8:
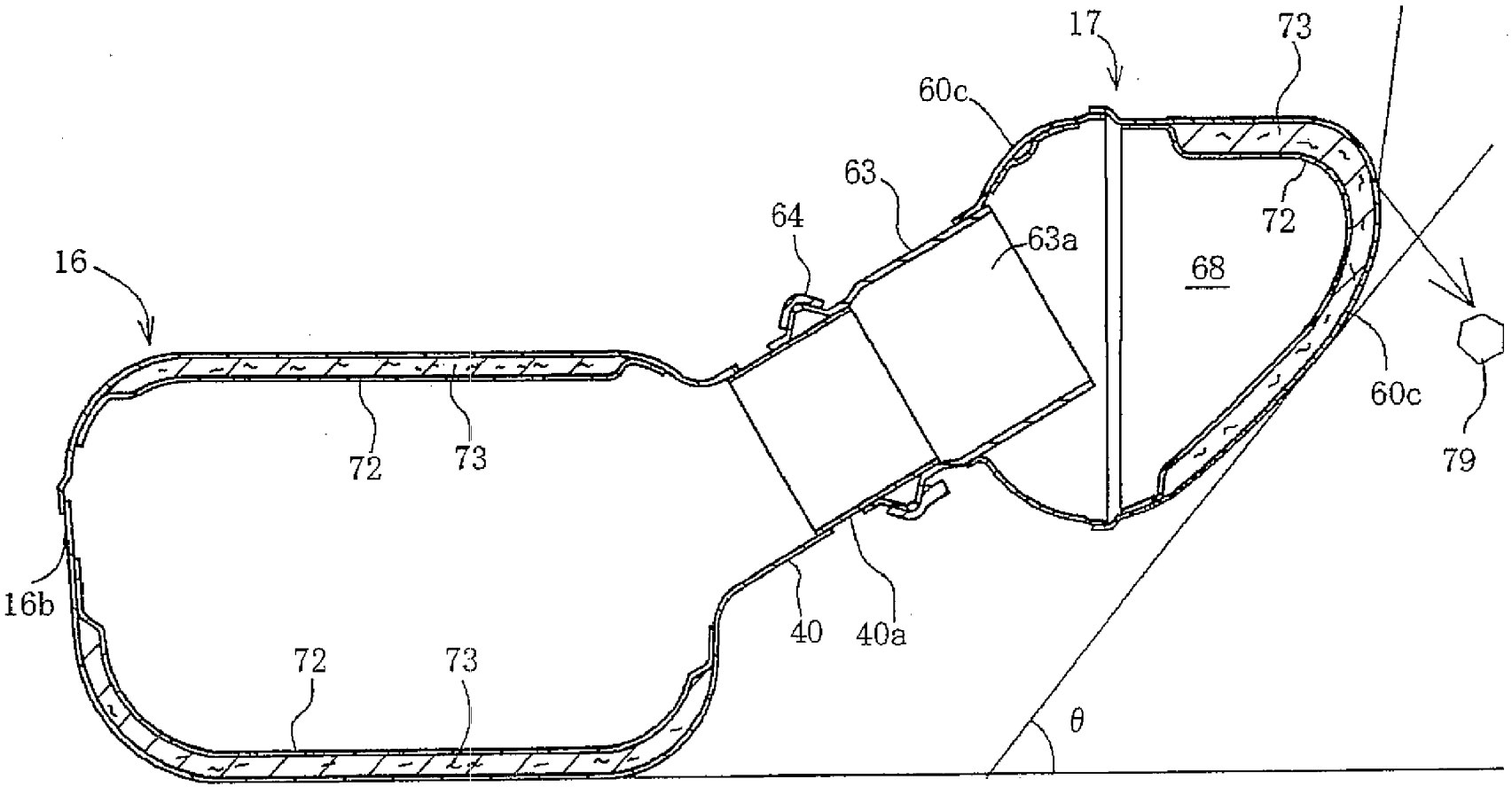
FIG. 8 is a cross-sectional view taken along line 8-8 of FIG. 4.

FIG. 8 is a cross-sectional view of the exhaust chamber 16 and muffler 17, taken along line 8-8 of FIG. 4. Referring to FIG. 8, the exhaust chamber 16 and the front portion 60 of the muffler 17 are arranged at respective different levels so that the front portion 60 is located higher than the exhaust chamber 16. In addition, the front portion 60 is formed in an appropriate inverted triangle in cross-section. The right lateral surface 60*c* is formed as a slant surface so that its lower portion faces the inside of the vehicle body, thereby providing a bank angle θ. Symbol H denotes a horizontal line coincident with the bottom surface of the exhaust chamber 16.

In this way, since the right lateral surface 60*c* is formed as the downward slant surface, scattered stones 79 or the like are bounced externally downward from the right lateral surface 60*c* so that they can be prevented from moving toward the exhaust chamber 16 and further toward the exhaust throttle valve 53.

Similarly, as shown in FIG. 5, the right lateral surface 60*c* of the exhaust chamber 16 is slanted such that the rear side thereof externally opens also as viewed from above. Thus, stones 79 or the like scattered from the front are bounced from the right lateral surface 60*c* toward the oblique outside and toward the rear, also thereby being prevented from moving toward the exhaust throttle valve 53.

As shown in FIGS. 6 and 7, the exhaust throttle valve 53 is attached to the rear exhaust pipe 47 at a position between the catalyst chamber 15 which is the connecting portion disposed near the lower portion of the engine and the exhaust chamber 16 disposed downstream of the catalyst chamber 15 so as to connect therewith through the rear exhaust pipe 47. Thus, the exhaust throttle valve 53 is surrounded by the catalyst chamber 15 and the exhaust chamber 16 to thereby protect the exhaust throttle valve 53 from disturbance due to stones or the like scattered by the front wheel 1 or the like.

In this case, the lateral width W1 of the catalyst chamber 15 disposed forward of the exhaust throttle valve 53 is made greater than the lateral width W of the rear exhaust pipe including the exhaust throttle valve 53. Thus, the catalyst chamber 15 can prevent the exhaust throttle valve 53 from disturbance due to scattered stones. In particular, the exhaust throttle valve 53 can be protected from disturbance due to stones or the like scattered from the front of the vehicle during operation of the vehicle. In addition, since the left lateral surface of the catalyst chamber 15 is externally protruded from the rear exhaust pipe 47 and from the exhaust throttle valve 53, the exhaust throttle valve 53 can further effectively be protected from disturbance due to stones or the like scattered from the front wheel side.

Similarly, the lateral width W2 of the exhaust chamber 16 disposed to the rear of the exhaust throttle valve 53 is made greater than the lateral width W of the rear exhaust pipe 47 including the exhaust throttle valve 53. Therefore, the exhaust throttle valve 53 can effectively be prevented from disturbance due to scattered stones bounced from the rear portion of the vehicle.

The right lateral surface 60*c* which is an external lateral surface of the muffler 17 slants to externally open toward the rear. Therefore, if the disturbance due to stones scattered from the front of the vehicle hits the right lateral surface 60*c* of the muffler 17, it can be bounced obliquely externally and to the rear by the right lateral surface 60*c* which is the externally opening slant surface. This can prevent the exhaust throttle valve from being hit by the disturbance due to stones scattered from the front of the vehicle and bounced from the muffler.

Further, the catalyst chamber 15 and exhaust chamber 16 which are components larger than the exhaust throttle valve 53 are disposed forward of and rearward of, respectively, the exhaust throttle valve 53 so as to put it therebetween. The back-and-forth length L2 of the rear exhaust pipe 47 which is an interval between the catalyst chamber 15 and the exhaust chamber 16 is made approximately equal to the back-and-forth length L1 of the exhaust throttle valve 53. Therefore, the back-and-forth interval of the exhaust throttle valve 53 can be reduced by the catalyst chamber 15 and by the exhaust chamber 16. This can prevent the exhaust throttle valve 53 from being hit by disturbance due to scattered stones or the like.

Since the exhaust throttle valve 53 is disposed to recede inside of the vehicle body from the external lateral portion of the catalyst 15, it can further easily be protected from the disturbance due to scattered stones or the like. Further, if the side stand 39 during storage or the boss 39*a* and attachment plate 39*c* which are attachment portions of the side stand are designed to overlap the outside of the exhaust throttle valve 53, the side stand 39 during storage or the attachment portions 39*a*, 39*c* cover the exhaust throttle valve 53 from laterally outside to protect it from disturbance due to scattered stones or the like.

In addition, the present invention is not limited to the embodiments described above and can be modified or applied in various ways within the principles of the invention. For example, as the collecting portion disposed below the engine, the catalyst chamber may be replaced by the exhaust chamber which is a mere expansion chamber.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust device for a motorcycle comprising:

a plurality of exhaust pipes connected to associated exhaust ports of a multicylinder engine;

a collecting portion collecting the exhaust pipes at a position close to a lower portion of the engine;

a rear exhaust pipe connected to the downstream side of the collecting portion;

an exhaust chamber connected to the downstream side of the rear exhaust pipe;

an exhaust outlet portion provided on the downstream side of the exhaust chamber;

a muffler connected to the downstream side of the exhaust outlet portion; and an exhaust throttle valve disposed inside a passage of the rear exhaust pipe and immediately upstream of the exhaust chamber for changing an amount of exhaust flow, wherein the exhaust throttle valve and a pulley connected to the valve are positioned in a recessed space disposed to recede from an external lateral portion of the collecting portion toward the inside of a vehicle body, such that a lateral width of the collecting portion is greater than a lateral width of the rear exhaust pipe including the pulley of the exhaust throttle valve, as viewed from above.

2. The exhaust device for a motorcycle according to claim 1, wherein a lateral width of the exhaust chamber is greater than that of the rear exhaust pipe including the exhaust throttle valve, as viewed from above.

3. The exhaust device for a motorcycle according to claim 1, wherein the muffler is formed such that a vehicle-widthwise outside thereof is slanted to externally open toward the rear.

4. The exhaust device for a motorcycle according to claim 1, wherein the muffler is formed such that a vehicle-widthwise outside thereof is slanted to externally open toward the rear.

5. The exhaust device for a motorcycle according to claim 2, wherein the muffler is formed such that a vehicle-widthwise outside thereof is slanted to externally open toward the rear.

6. The exhaust device for a motorcycle according to claim 1, wherein a back-and-forth length of a portion of the exhaust throttle valve, disposed outside of the rear exhaust pipe is approximately equal to a back-and-forth length of the rear exhaust pipe.

7. The exhaust device for a motorcycle according to claim 1, wherein the exhaust throttle valve is disposed to recede from an external lateral portion of the collecting portion toward the inside of a vehicle body.

8. The exhaust device for a motorcycle according to claim 7, wherein a side stand during storage or an attachment portion overlaps the outside of the exhaust throttle valve as viewed from the side.

9. An exhaust system comprising:

a plurality of exhaust pipes operatively connected to associated exhaust ports of a multicylinder engine;

a collecting portion collecting the exhaust pipes at a position close to a lower portion of the engine;

a catalyst chamber being operatively connected to the collecting portion;

a rear exhaust pipe having a predetermined diameter connected to the downstream side of the catalyst chamber;

an exhaust chamber having a predetermined diameter connected to the downstream side of the rear exhaust pipe;

an exhaust throttle valve disposed inside a passage of the rear exhaust pipe to change an amount of exhaust flow with a case for operating the exhaust throttle valve being disposed in a space adjacent to the predetermined diameter of the rear exhaust pipe which is less than the predetermined diameters of the catalyst chamber and the exhaust chamber, wherein the exhaust throttle valve and a pulley connected to the valve are positioned in a recessed space disposed to recede from an external lateral portion of the collecting portion the inside of a vehicle body, such that a lateral width of the collecting portion is greater than a lateral width of the rear exhaust pipe including the pulley of the exhaust throttle valve, as viewed from above.

10. The exhaust system according to claim 9, wherein a lateral width of the catalyst chamber is greater than a lateral width of the rear exhaust pipe including the exhaust throttle valve, as viewed from above.

11. The exhaust system according to claim 9, wherein a lateral width of the exhaust chamber is greater than that of the rear exhaust pipe including the exhaust throttle valve, as viewed from above.

12. The exhaust system according to claim 10, wherein a lateral width of the exhaust chamber is greater than that of the rear exhaust pipe including the exhaust throttle valve, as viewed from above.

13. The exhaust system according to claim 9, wherein a muffler is connected to the exhaust chamber and is formed such that a vehicle-widthwise outside thereof is slanted to externally open toward the rear.

14. The exhaust system according to claim 10, wherein a muffler is connected to the exhaust chamber and is formed such that a vehicle-widthwise outside thereof is slanted to externally open toward the rear.

15. The exhaust system according to claim 11, wherein a muffler is connected to the exhaust chamber and is formed such that a vehicle-widthwise outside thereof is slanted to externally open toward the rear.

16. The exhaust system according to claim 9, wherein a back-and-forth length of a portion of the exhaust throttle valve, disposed outside of the rear exhaust pipe is approximately equal to a back-and-forth length of the rear exhaust pipe.

17. The exhaust system according to claim 9, wherein the exhaust throttle valve is disposed to recede from an external lateral portion of the collecting portion toward the inside of a vehicle body.

18. The exhaust system according to claim 17, wherein a side stand during storage or an attachment portion overlaps the outside of the exhaust throttle valve as viewed from the side.

19. The exhaust system according to claim 1, wherein a catalyst chamber is operatively connected at its upstream side to the collecting portion and by the rear exhaust pipe at its downstream side to the exhaust chamber, and the exhaust throttle valve is disposed between said catalyst chamber and said exhaust chamber.

20. The exhaust system according to claim 19, wherein the exhaust throttle valve is surrounded by the catalyst chamber and the exhaust chamber thereby protecting the exhaust throttle valve from road disturbances.

* * * * *